United States Patent [19]

Castilla

[11] 4,112,583

[45] Sep. 12, 1978

[54] GUN LEAD SIGHT

[76] Inventor: Antonio Jose Castilla, 1804 Armstrong Dr., Plano, Tex. 75074

[21] Appl. No.: 741,674

[22] Filed: Nov. 15, 1976

[51] Int. Cl.[2] ..... F41G 1/00; F41G 11/00

[52] U.S. Cl. ..... 33/261; 33/242

[58] Field of Search ..... 33/261, 242

[56] References Cited

U.S. PATENT DOCUMENTS

| | | | |
|---|---|---|---|
| 752,962 | 2/1904 | Eby | 33/261 |
| 3,178,824 | 4/1965 | Callihoe | 33/261 |

*Primary Examiner*—Steven L. Stephan

*Attorney, Agent, or Firm*—Warren H. Kintzinger

[57] ABSTRACT

A lead sight with numbers coinciding with the numbered positions on a standard skeet range printed on a transversely extended transparent member mounted by a strap above gun barrels toward the muzzle end. "High" and "Low", also imprinted on the transparent member, correspond to the high house and the low house from which the clay pigeons are released. The "lead sight" helps the beginner in skeet shooting to lead the bird properly and helps the experienced shooter having a problem with one or more positions.

9 Claims, 7 Drawing Figures

GUN LEAD SIGHT

Figure 1:
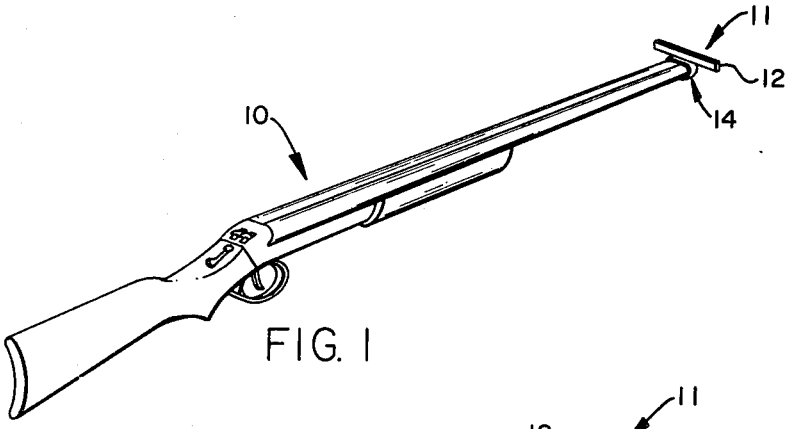

This invention relates in general to gun sights and, in particular, to a lead sight with information and sighting marks thereon specifically associated with trap or skeet firing positions and target ejecting houses.

Skeet or trap shooters must lead a clay pigeon the proper distance to score a hit. This can turn out to be more of a problem than initially anticipated, particularly for the beginner and even for some experienced shooters in moving from position to position on a skeet or trap range. As a shooting aid the "lead sight" helps in acquainting the shooter with the various leads required in each of the positions in shooting skeet. Using the sight, take aim at the clay bird as it leaves its high or low house, as the case may be, making sure that the number on the lead sight corresponds with the skeet position. Then, following the bird's flight, when the selected number covers the bird it is an on target state to fire. Frequent use of the sight familiarizes one with the number pattern such that with attainment of high proficiency, one may then shoot without the sight. If, however, trouble develops for any position the lead sight may be again used to correct the difficulties for any position required. Generally, once memorized, the shooter will be able to recall the various leads for each of the skeet positions.

It is, therefore, a principal object of this invention to provide a gun sighting aid enabling the skeet or trap shooter to properly lead clay pigeons for optimized scoring of hits.

Another object is to provide a lead sight, particularly designed for use from the various positions of a standard skeet or trap range.

A further object is to provide a lead sight that helps the experienced shooter who has developed problems at a particular position (or several positions on a skeet or trap range).

Features of this invention, useful in accomplishing the above objects include, in a gun lead sight for use on skeet and trap ranges, a transversely extended transparent member with numbers, "high" and "low" and T (left and right) imprinted on the transparent member mounted by a strap above gun barrels toward the muzzel end. The transparent member is transparent plastic mounted on a wrap around "Velcro" material strap the overlapping ends of which interlock together in a separable interlock. This permits convenient mounting of the lead sight above single, double, and over/under barrelled guns and switching from gun to gun. The lead sight is also provided with a "P" used at position 8, for birds from the low house from position 7, and for straight birds at position 3.

Figure 2:
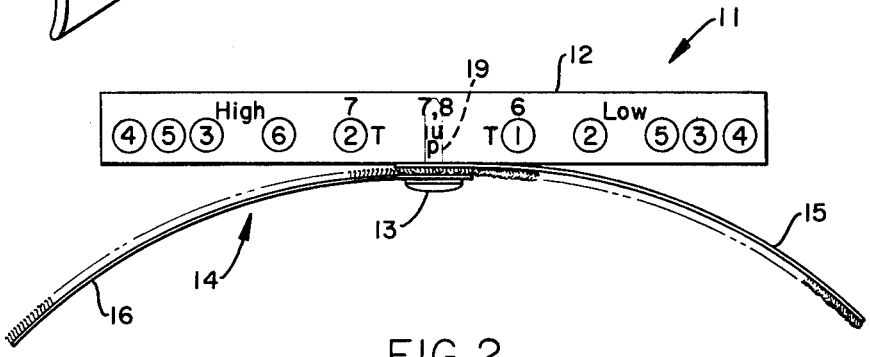
Figure 3:
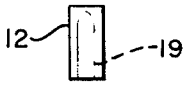
Figure 4:
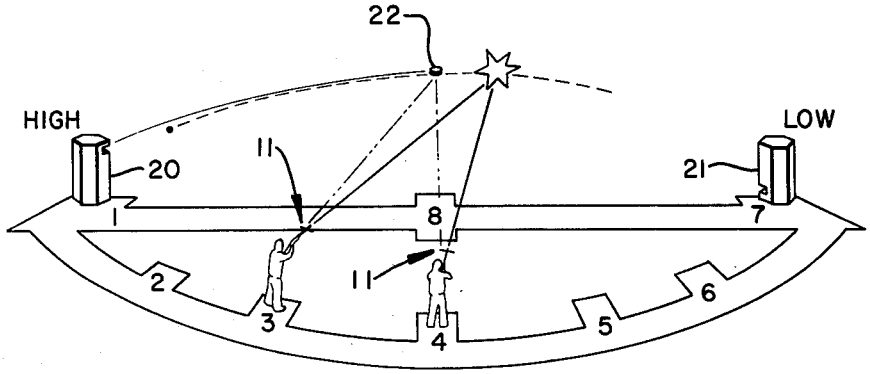
Figure 5A:
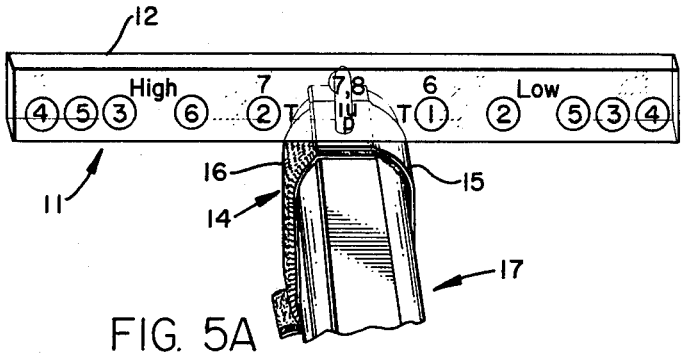
Figure 5B:
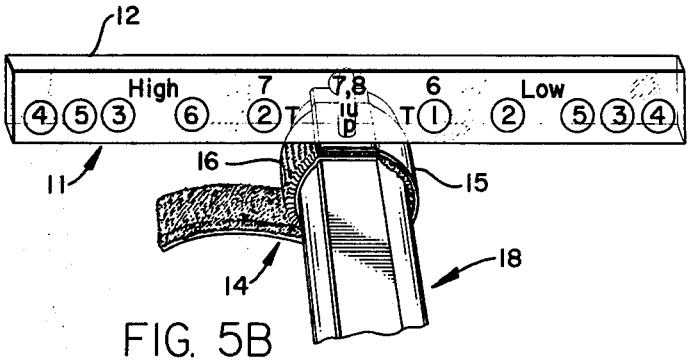
Figure 5C:
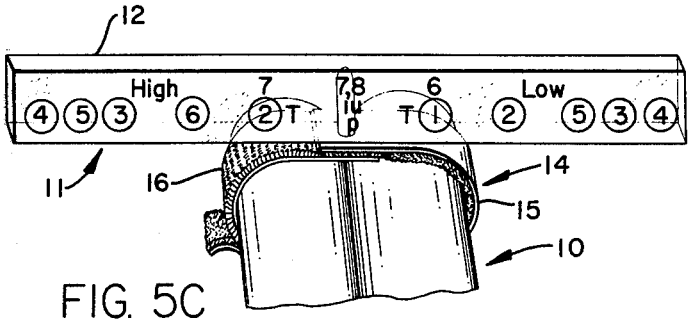

Specific embediments representing what are presently regarded as the best modes of carrying out the invention are illustrated in the accompanying drawings:

In the drawings:

FIG. 1 represents a perspective view of a double-barrelled shotgun mounting my lead sight at the muzzle end;

FIG. 2, a front face view of a lead sight with the wrap around "Velcro" strap in the uninstalled state;

FIG. 3, a side end view of the transparent lead sight body;

FIG. 4, a standard skeet range with a high house at the left and a low house at the right and the numbered shooting positions; and, FIGS. 5A, 5B and 5C, partial perspective views of the muzzle ends of an over/under barrelled gun, a single barrel gun, and a double barrelled gun.

Referring to the drawings:

The double-barrelled shotgun 10 of FIG. 1 is shown to mount a lead sight assembly 11 on the gun barrelling toward the muzzle end. The lead sight assembly 11, shown in the non-mounted state in FIG. 2, has an elongate rectangular transparent lead sight member 12 mounted at the center by a pin member 13 above a wrap around clamp in the form of a "Velcro" strap 14. "Velcro" is a commercially available cloth interlocking system of two different materials — one a fuzzy faced material on backing material and the other a multi-hooked fiber material, also on a backing material, that interlocks with the fuzzy faced material when they are brought together. The two interlocking "Velcro" material strap sections 15 and 16 overlap through the area of pin member 13 mounting of lead sight member 12 thereon and extend in opposite directions for wrap around mounting on the barrelling of guns. When the lead sight assembly 11 is mounted on a gun, the outer ends of the "Velcro" material strap sections 15 and 16 are brought into overlapped locking engagement, such as is the case with mounting on barrelling of over/under gun 17 in FIG. 5A, of single barrel gun 18 in FIG. 5B, and of double barrelled shotgun 10 shown in greater lead sight assembly 11 and mounting detail in FIG. 5C than in FIG. 1.

The lead sight member 12, is indicated in the end view of FIG. 3 as having an opening 19 that receives the shank of pin member 13 in order that the lead sight member 12 be mounted above and to extend transversely to gun barrelling it is mounted on. Referring to FIG. 2 again, please note that the lead sight 11 is based on a mathematical principle that use of the proper lead angle by the shooter results in the shot pattern ultimately coinciding with the clay pigeon (or bird) at each position on the standard skeet or trap range. Each number facing the shooter on the lead sight member 12 that is made of transparent plastic (or other transparent material) coincides with that number position on a skeet range (as shown in FIG. 4). High and low on the lead sight member 12 refers to the high house 20 or low house 21 from which clay pigeons are released. For example, if the shooter is standing at position three (3) and shooting at the high bird sight the bird 22 over the "3" on the left side of the lead sight member 12 marked "high". If the shooter is standing at position three (3) and shooting at the low bird, sight the bird over the "3" on the right side of the sight marked "low". Much the same logic applies to use of the lead sight from other skeet range numbered positions such as a person shown shooting from position four (4) or the other positions. The lead sight is marked for trap shooting with a T on the left and T on the right. The bird is to always be picked up on the opposite side of the lead sight from the bird flight. For example, if the bird comes out of the trap house flying to the left the bird is to be sighted over the right (low) T on the lead sight member 12 for proper bird lead.

Thus, the lead sight helps in acquainting the shooter with the various leads respectively necessary in each of the skeet range positions. Aim is taken at the clay bird as it leaves the house making sure that the number being sighted on the lead sight corresponds with the skeet range position. Then, following the birds flight, when the the selected number covers the bird the gun is on target to fire. Obviously, frequent use of the lead sight familiarizes one with the number pattern and when proficient enough one may shoot quite well without it. Generally once memorized the shooter will be able to recall the various leads for each of the skeet positions. Further, should difficulties develop for the otherwise proficient shooter at any position or if the shooter has been inactive from skeet and/or trap shooting for an extended period of time use of the lead sight will quickly reorient him and bring proper leads for respective positions back to mind.

Whereas this invention is here illustrated and described with respect to specific embodiments hereof, it should be realized that various changes may be made without departing from the essential contributions to the art made by the teachings hereof.

I claim:

1. In a lead sight for guns: a transparent elongate member having visually discernable numbers carried on the face thereof at respective transversely located positions, said numbers per se comprising respective front sight indicia usable for corresponding numbered shooting positions of a standard skeet range with predetermined ones of said numbers carried at first and second ones of said transversely located positions on respective opposite sides of the transverse center region of said elongate member for use with each of high-house and low-house released targets while at those predetermined shooting positions, mounting means for mounting said transparent elongate member on barrelling of a gun adjacent the muzzle end of the gun barrelling and wherein said mounting means includes flexible strapping having interlocking overlapping ends for inclosing and locking on the barrelling of guns.

2. The lead sight for guns of claim 1, wherein said transparent elongate member is fastened to said mounting means in the transverse center region of said transparent elongate member; and with said mounting means adapted to mount said transparent elongate member, above the gun barrelling and to extend transversely to the directional axis of the gun barrelling.

3. The lead sight for guns of claim 2, wherein said transparent elongate member also has High printed thereon on the left and Low and on the right corresponding to the high house and the low house of a standard skeet range.

4. The lead sight for guns of claim 3, wherein said transparent elongate member also has T printed on the left and T on the right in positions marked for trap shooting.

5. The lead sight for guns of claim 3, wherein said transparent elongate member also has a P printed on at the center for point blank shooting from several skeet range positions.

6. The lead sight for guns of claim 2, wherein said transparent elongate member is a relatively stiff transparent block of plastic.

7. The lead sight for guns of claim 1, wherein said mounting means is adapted for wrap-around mounting of said lead sight for guns on both single barrelled and double barrelled guns.

8. The lead sight for guns of claim 7, wherein said mounting means includes a pin interconnect between said flexible strapping and said transparent elongate block of plastic.

9. The lead sight for guns of claim 8, wherein said flexible strapping comprises two sections of cloth interlock mating material.

* * * * *